US009216332B1

(12) United States Patent
Ehlers et al.

(10) Patent No.: US 9,216,332 B1
(45) **Date of Patent: *Dec. 22, 2015**

(54) GOLF CLUB HEAD WITH ADJUSTABLE CENTER OF GRAVITY

(71) Applicant: CALLAWAY GOLF COMPANY, Carlsbad, CA (US)

(72) Inventors: Steven M. Ehlers, Poway, CA (US); Denver Holt, Carlsbad, CA (US); James A. Seluga, Carlsbad, CA (US); Wee Joung Kim, Vista, CA (US); Scott R. Manwaring, Carlsbad, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/180,795

(22) Filed: Feb. 14, 2014

Related U.S. Application Data

(63) Continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/904,383, filed on Nov. 14, 2013, provisional application No. 61/898,956, filed on Nov. 1, 2013, provisional application No. 61/657,247, filed on Jun. 8, 2012, provisional application No. 61/684,079, filed on Aug. 16, 2012, provisional application No. 61/665,203, filed on Jun. 27, 2012.

(51) Int. Cl.
*A63B 53/06* (2015.01)
*A63B 53/04* (2015.01)
*A63B 59/00* (2015.01)

(52) U.S. Cl.
CPC ..... *A63B 53/06* (2013.01); *A63B 53/0466* (2013.01); *A63B 59/0074* (2013.01)

(58) Field of Classification Search
CPC ..... A63B 53/06; A63B 53/0466; A63B 2053/0491; A63B 2053/0433; A63B 2053/0495; A63B 59/0074
See application file for complete search history.

(56) References Cited

U.S. PATENT DOCUMENTS

| | | | | | |
|---|---|---|---|---|---|
| 1,133,129 | A | * | 3/1915 | Govan | 473/337 |
| 3,652,094 | A | * | 3/1972 | Glover | 473/337 |
| 3,770,279 | A | * | 11/1973 | Phinny | 473/313 |
| 5,447,309 | A | * | 9/1995 | Vincent | 473/345 |
| 5,941,782 | A | * | 8/1999 | Cook | 473/346 |
| 7,997,998 | B2 | * | 8/2011 | Bennett et al. | 473/328 |
| 8,206,243 | B2 | * | 6/2012 | Stites | 473/334 |
| 8,376,878 | B2 | * | 2/2013 | Bennett et al. | 473/334 |
| 8,591,352 | B2 | * | 11/2013 | Hirano | 473/336 |

(Continued)

FOREIGN PATENT DOCUMENTS

| | | | |
|---|---|---|---|
| GB | 303290 | | 1/1929 |
| JP | 2006-320493 | * | 11/2006 |
| JP | 2011125623 A | * | 6/2011 |

*Primary Examiner* — Stephen Blau
(74) *Attorney, Agent, or Firm* — Rebecca Hanovice; Michael Catania; Sonia Lari

(57) ABSTRACT

A golf club head comprising a plurality of center of gravity adjustment assemblies and a flat panel that attenuates sound and, in certain embodiments, connects the center of gravity adjustment assemblies, is disclosed herein.

14 Claims, 3 Drawing Sheets

(56) References Cited

U.S. PATENT DOCUMENTS

2002/0137576 A1 9/2002 Dammen
2010/0075773 A1* 3/2010 Casati, Jr. ..... 473/334
2010/0144461 A1* 6/2010 Ban ..... 473/338
2011/0152000 A1* 6/2011 Sargent et al. ..... 473/334
2013/0109501 A1* 5/2013 Stites et al. ..... 473/335

* cited by examiner

GOLF CLUB HEAD WITH ADJUSTABLE CENTER OF GRAVITY

CROSS REFERENCES TO RELATED APPLICATIONS

The present application claims priority to U.S. Provisional Patent Application No. 61/904,383, filed on Nov. 14, 2013, and is a continuation in part of U.S. patent application Ser. No. 14/173,615, filed on Feb. 5, 2014, which claims priority to U.S. Provisional Patent Application No. 61/898,956, filed on Nov. 1, 2013, and which is a continuation in part of U.S. patent application Ser. No. 14/039,102, filed on Sep. 27, 2013, which is a continuation of U.S. patent application Ser. No. 13/797,404, filed on Mar. 12, 2013, which claims priority to U.S. Provisional Patent Application Nos. 61/657,247, filed on Jun. 8, 2012, 61/684,079, filed on Aug. 16, 2012, and 61/665,203, filed on Jun. 27, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head with adjustable center of gravity assemblies and sound attenuation features.

2. Description of the Related Art

The prior art discloses various designs with center of gravity adjustments to improve golf club performance, but fails to provide a golf club with designs that efficiently alter center of gravity parameters and consequentially enable the golf club to be swung faster along its path and contribute to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to adjust the height of the center of gravity. A change in height of the center of gravity would allow the driver club head to travel faster along its path and contribute to an improved impact event with the golf ball, resulting in higher golf ball velocities and consequentially, in longer golf shots.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows for higher inertias and robust face design of current drivers in addition to a golf club head design wherein the location, and particularly the height, of the center of gravity is adjustable.

BRIEF SUMMARY OF THE INVENTION

The main objective of the present invention is to improve the location, and particularly the height, of the center of gravity. To improve the height of the center of gravity, a golf club head is created which has center of gravity height adjustment assembly. This multiple designs enabling adjustment of the center of gravity can affect the moment of inertia and ultimately the forgiveness of the golf club head.

Another object of the present invention is an adjustable weighting feature for vertical center of gravity control which is placed to maximize effectiveness and may be entirely concealed from view at address.

Yet another aspect of the present invention is a golf club head comprising a face component, a body comprising a crown, a sole, a heel side, a toe side, a hollow interior, and a rear side, first and second center of gravity adjustment assemblies, and a flat panel, wherein each of the first and second center of gravity adjustment assemblies is disposed within the hollow interior and extends from the sole to the crown, and wherein the flat panel is disposed within the hollow interior and extends from the sole to the crown. In some embodiments, the flat panel may connect the first and second center of gravity adjustment assemblies to each other. In a further embodiment, the first center of gravity adjustment assembly may be disposed proximate the heel side, the second center of gravity adjustment assembly may be disposed proximate the toe side, and in yet a further embodiment, the flat panel may connect the first and second center of gravity adjustment assemblies to one another.

In another embodiment, the flat panel may extend between the first and second center of gravity adjustment assemblies without making contact with either center of gravity adjustment assembly, and further may extend so that it does not make contact with the face or the rear side. In another embodiment, the flat panel may extend parallel to the face, while in an alternative embodiment the flat panel may extend perpendicular to the face.

In another embodiment, the flat panel may comprise at least one hole, and further may comprise a mesh material. In some embodiments, the flat panel may be composed of a lightweight material, which may be selected from the group consisting of composite, plastic, and a lightweight metal alloy.

In a further embodiment, the golf club head of claim may further comprise a slidable weight assembly comprising a pair of parallel rails, which may be disposed on the sole and extend perpendicular to the face towards the rear side without making contact with the face. In a further embodiment, the slidable weight assembly may comprise at least one slidable weight sized to fit over the pair of parallel rails. In some embodiments, a first distance may represent the distance between the face and a forward-most edge of the flat panel, a second distance may represent the distance between the face and a forward-most edge of the slidable weight assembly, and the first distance may be greater than or equal to the second distance. In a further embodiment, the first distance is greater than the second distance. In yet another embodiment, the sole may comprise a shallow channel and the slidable weight assembly may be disposed within the shallow channel.

In another embodiment, the golf club head may be selected from the group consisting of a wood-type head, an iron-type head, a hybrid-type head, and a putter-type head. In a further embodiment, the golf club head is a wood-type head, such as a driver-type head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on the construction used in a driver head characterized by a composite crown adhesively bonded to a cast titanium body, which comprises a face and a sole, and may also comprise a ribbon or skirt portion. However, the embodiments disclosed herein may be used with other golf club head constructions, including but not limited to all titanium, all composite, and a composite body with metal face cup or insert.

Figure 1:
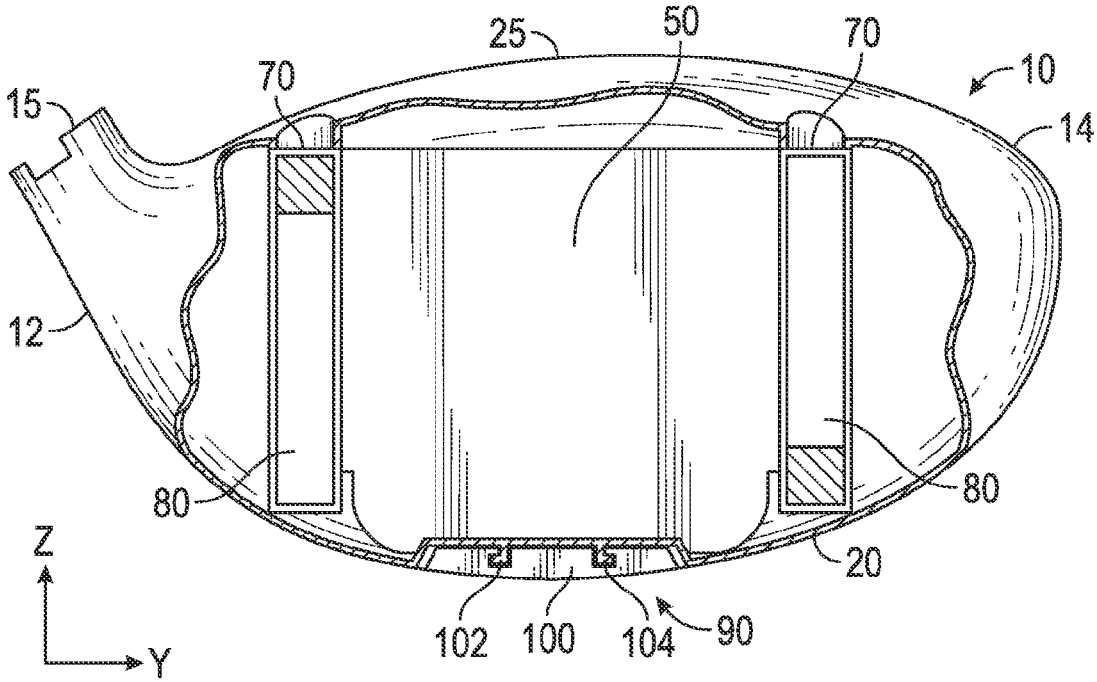
FIG. 1 is a cross-sectional view of a first embodiment of the golf club head of the present invention.
Figure 2:
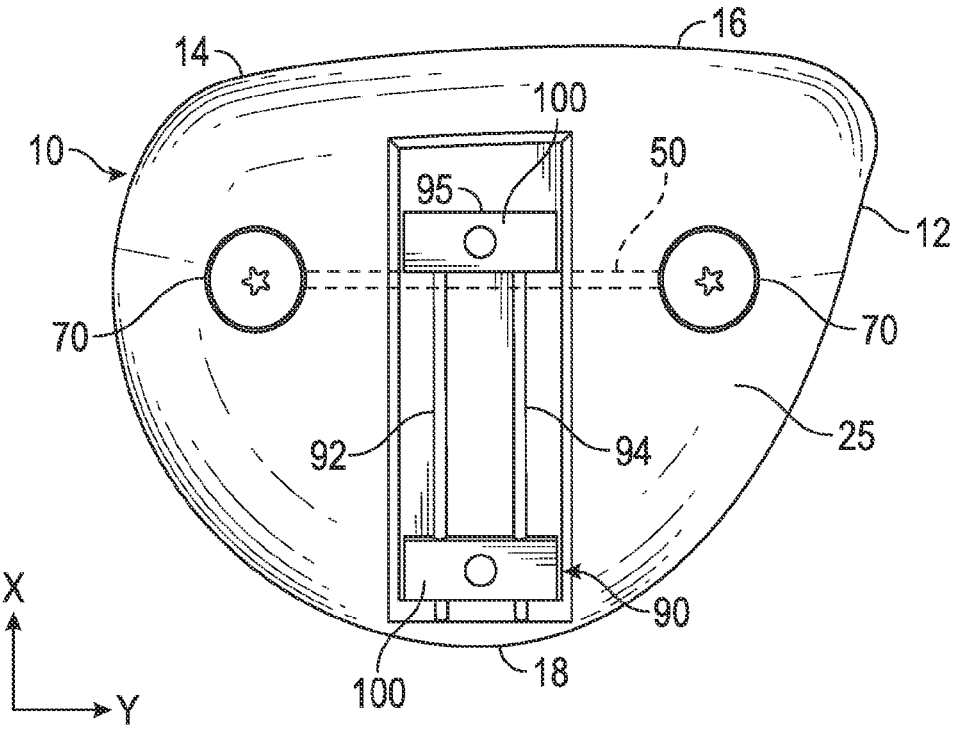
FIG. 2 is a bottom plan view of the embodiment shown in FIG. 1.
Figure 3:
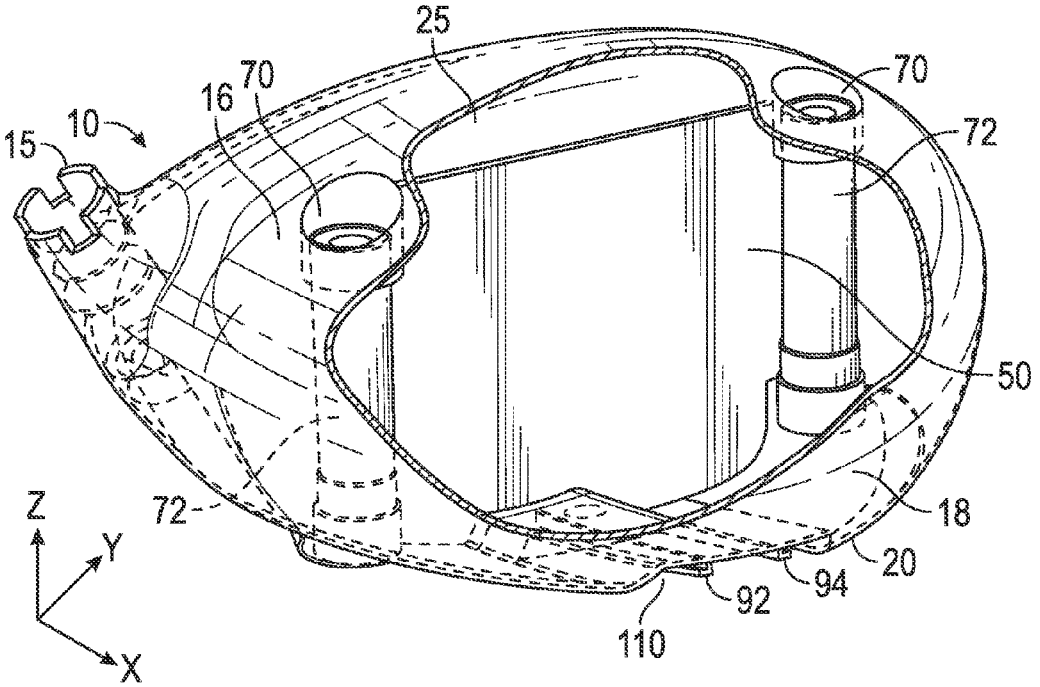
FIG. 3 is a rear perspective, partially transparent view of the embodiment shown in FIG. 1 with part of the body cut away to reveal the interior of the golf club head.

In a first, preferred embodiment of the present invention shown in FIGS. 1-3, the golf club head 10, which has an adjustable hosel 15, includes two center of gravity height adjustment assemblies 70, which preferably are selected from the assemblies disclosed in U.S. patent application Ser. Nos. 13/797,404 and 14/039,102, the disclosure of each of which is hereby incorporated by reference in its entirety herein. Most preferably, each center of gravity height adjustment assembly 70 includes a tube 72 that extends from the sole 20 to the crown 25 within the golf club head 10 and a weight cartridge 80 that fits within the tube 72 and can be flipped to adjust the location of the golf club head's center of gravity. In alternative embodiments, the weight cartridge 80 can be replaced with an electronic measuring device such as an accelerometer, which transmits information about a swing and/or an impact with a golf ball to a receiver to gather information about a golfer's abilities.

Figure 5:
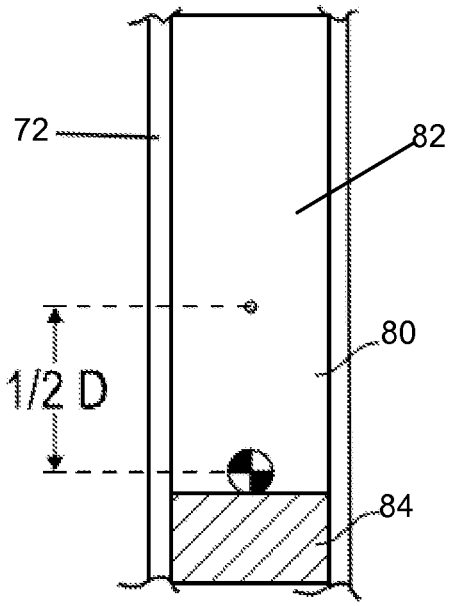
FIG. 5 is a cross-sectional view of a center of gravity height adjustment assembly of the present invention comprising a tube and a cartridge, wherein the distance from the midpoint of the cartridge to the center of gravity of the cartridge is shown.

The first center of gravity adjustment assembly 70 is located proximate the heel side 12 of the golf club head 10, the second center of gravity adjustment assembly 70 is located proximate the toe side 14 of the golf club head 10, and both of these assemblies 70 extend from the sole 20 to the crown 25 proximate the face 16. The cartridges 80 (or electronic measuring devices) retained within these assemblies 70 may be accessible via the crown 25 and/or the sole 20, preferably have masses of 12 grams and 5 grams, and allow for the creation of four different center of gravity height positions within the golf club head 10. The cartridges 80 may further comprise a polymer 82 and a slug 84 composed of a material having a specific gravity greater than that of the polymer 82, as shown in FIG. 5. The golf club head 10 bias can also be adjusted by swapping the cartridges 80 between the first and second assemblies 70.

The preferred design for a golf club head 10 incorporating a center of gravity height adjustment assembly 70 comprising a tube 72 and a weight cartridge 80 can be determined using the equation $D \geq 0.065(1+M/M_T)$, wherein M is the mass of the golf club head 10, L is the length of the cartridge 80 and $M_T$ is the mass of the cartridge 80, the distance from the midpoint of the length L to a center of gravity of the cartridge 80 when the cartridge 80 is disposed within the tube 72 such that the slug 84 is closer to the sole 20 may be defined as ½D, and D is the total center of gravity distance change for the cartridge 80 when its orientation is changed within the tube 72 by being flipped.

The golf club head 10 also includes a slidable weight assembly 90 with a pair of parallel rails 92, 94 and at least one slidable weight 100 having a pair of parallel grooves 102, 104 that receive the parallel rails 92, 94, and is disposed within a shallow channel 110 in the sole 20. Each slidable weight 100 preferably has a mass of 1 to 10 grams, more preferably a mass of 2.5 grams if two slidable weights 100 are used and 7 grams if only one slidable weight 100 is used. As shown in FIG. 2, the slidable weight assembly may include two slidable weights 100, each of which is affixed to an exterior portion of the parallel rails 92, 94 and is movable in a face 16 to rear 18 direction, e.g., along the X-axis. In other embodiments, the parallel rails 92, 94 may extend in a heel 12 to toe 14 (Y-axis) direction, may curve along a periphery of the golf club head 10 body, or may extend diagonally across the body of the golf club head 10.

In the preferred embodiment, the center of gravity height adjustment assemblies 70 are connected to one another with a flat, internal panel 50 that extends along a YZ plane, as shown in FIGS. 1-3. This panel 50, which preferably is composed of a composite material but may also be composed of a polymeric material such as plastic or a lightweight metal alloy, improves the overall sound of the golf club head 10 and also prevents the center of gravity height adjustment assemblies 70 from vibrating or moving within the golf club head 10 when the golf club head 10 makes contact with a golf ball. In an alternative embodiment, shown in FIG. 4, the panel 50 extends along an XZ plane and is disposed between the center of gravity adjustment assemblies 70 without making contact with either of them. In other embodiments, the panel 50 may extend along the XZ plane and connect with one of the center of gravity adjustment assemblies 70.

Figure 4:
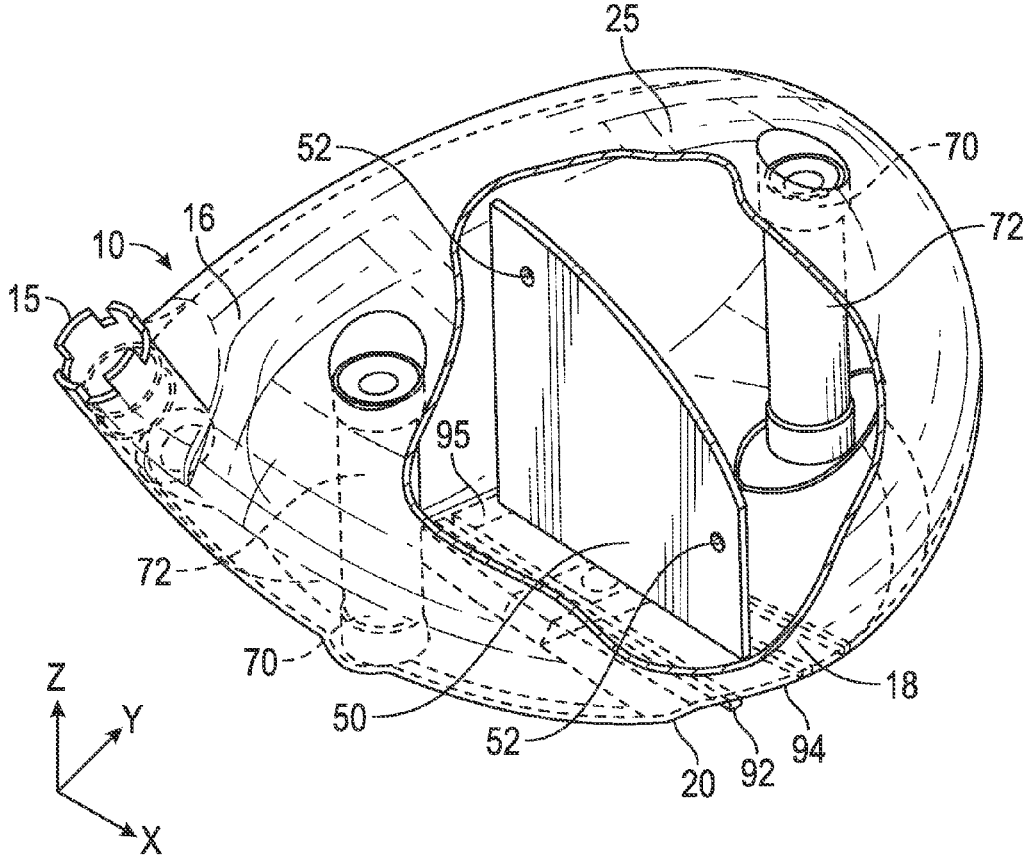
FIG. 4 is a rear perspective, partially transparent view of a second embodiment of the present invention with part of the body cut away to reveal the interior of the golf club head.

The panel 50 preferably is a solid piece of material without any apertures, as shown in FIGS. 1-3, but in other embodiments may include one or more holes 52 as shown in FIG. 4 or may be a mesh- or net-like material to reduce its overall weight. In any of these embodiments, the panel 50 does not make contact with the face 16 or the rear-most edge 18 of the golf club head 10, and while it may terminate proximate the face 16, the panel 50 preferably is not located closer to the face than a forward-most edge 95 of the slidable weight assembly 90.

Each of the embodiments disclosed herein are described and shown in combination with a driver-type golf club head, but may also be used with other wood-type golf club heads (e.g., fairway woods), irons, hybrids, and putters, which may have any material composition known to a person skilled in the art. They allow a user to adjust the location of the center of gravity along vertical z- and horizontal x- and y-axes, and can disposed anywhere on the body.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a metal face component;

a body comprising a composite crown, a metal sole, a heel side, a toe side, a hollow interior, and a rear side;

a first center of gravity adjustment assembly disposed proximate the heel side;

a second center of gravity adjustment assembly disposed proximate the toe side; and a flat panel, wherein each of the first and second center of gravity adjustment assemblies is disposed within the hollow interior and extends from the sole to the crown, wherein at least one of the first and second center of gravity adjustment assemblies comprises a tube and a cartridge sized to fit within the tube, wherein the cartridge comprises a length L, a mass $M_T$, a polymer material, and a slug having a specific gravity that is greater than the specific gravity of the polymer material, wherein changing the orientation of the cartridge within the tube changes the location of the golf club head's center of gravity along a vertical Z axis, wherein the golf club head has a mass M, wherein the distance from the midpoint of the length L to a center of gravity of the cartridge when the cartridge is disposed within the tube such that the slug is closer to the sole is defined as ½D, wherein the golf club head satisfies the equation $D \geq 0.065(1+M/M_T)$, wherein D is the total center of gravity distance change for the cartridge when its orientation is changed within the tube by being flipped, and wherein the flat panel is disposed within the hollow interior, extends from the sole to the crown, and connects the first and second center of gravity adjustment assemblies to each other.

2. The golf club head of claim 1, wherein the flat panel extends parallel to the face.

3. The golf club head of claim 1, wherein the flat panel comprises at least one hole.

4. The golf club head of claim 1, wherein the flat panel comprises a mesh material.

5. The golf club head of claim 1, wherein the flat panel is composed of a lightweight material.

6. The golf club head of claim 5, wherein the material is selected from the group consisting of composite, plastic, and a lightweight metal alloy.

7. The golf club head of claim 1, further comprising a slidable weight assembly comprising a pair of parallel rails, wherein the slidable weight assembly is disposed on the sole and extends perpendicular to the face towards the rear side, and wherein the slidable weight assembly does not make contact with the face.

8. The golf club head of claim 7, further comprising at least one slidable weight sized to fit over the pair of parallel rails.

9. The golf club head of claim 7, wherein a first distance represents the distance between the face and a forward-most edge of the flat panel, wherein a second distance represents the distance between the face and a forward-most edge of the slidable weight assembly, and wherein the first distance is greater than or equal to the second distance.

10. The golf club head of claim 9, wherein the first distance is greater than the second distance.

11. The golf club head of claim 7, wherein the sole comprises a shallow channel, and wherein the slidable weight assembly is disposed within the shallow channel.

12. The golf club head of claim 1, wherein the golf club head is selected from the group consisting of a wood-type head, an iron-type head, a hybrid-type head, and a putter-type head.

13. The golf club head of claim 12, wherein the golf club head is a wood-type head.

14. The golf club head of claim 13, wherein the golf club head is a driver-type head.

* * * * *